US006355121B1

(12) United States Patent
Opalka et al.

(10) Patent No.: US 6,355,121 B1
(45) **Date of Patent: *Mar. 12, 2002**

(54) MODIFIED ETCHING BATH FOR THE DEPOSITION OF A PROTECTIVE SURFACE CHEMISTRY THAT ELIMINATES HYDROGEN ABSORPTION AT ELEVATED TEMPERATURES

(75) Inventors: Susanne M. Opalka; Brian R. Strohmeier, both of Pittsburgh, PA (US)

(73) Assignee: Alcoa Inc., Pittsburgh, PA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/042,864

(22) Filed: Mar. 17, 1998

Related U.S. Application Data

(63) Continuation-in-part of application No. 08/756,289, filed on Nov. 25, 1996, now Pat. No. 5,753,056.

(51) Int. Cl.[7] ..... C03C 25/68; C22F 1/04; C23F 1/00

(52) U.S. Cl. ..... 148/703; 148/688; 216/55; 216/103

(58) Field of Search ..... 216/55, 83, 100, 216/102, 103; 148/688, 703

(56) References Cited

U.S. PATENT DOCUMENTS

| | | | | |
|---|---|---|---|---|
| 2,995,479 A | * | 8/1961 | Cochran et al. | 148/13.1 |
| 3,607,484 A | | 9/1971 | Marukawa et al. | 156/22 |
| 3,689,417 A | | 9/1972 | Oikawa et al. | 252/79.3 |
| 4,339,282 A | | 7/1982 | Lada et al. | 134/3 |
| 4,391,655 A | | 7/1983 | Thurston et al. | 148/20.6 |
| 4,425,185 A | | 1/1984 | Fishter et al. | 156/656 |
| 4,482,442 A | | 11/1984 | Kohl et al. | 204/129.3 |
| 4,584,067 A | * | 4/1986 | Hutchins et al. | 204/33 |
| 4,686,021 A | | 8/1987 | Nakanishi et al. | 204/129.75 |
| 4,886,616 A | | 12/1989 | Yamasoe et al. | 252/142 |
| 5,030,323 A | | 7/1991 | Awad | 156/665 |
| 5,227,009 A | * | 7/1993 | Sunakawa et al. | 156/634 |
| 5,387,361 A | * | 2/1995 | Kohara et al. | 252/79.1 |
| 5,413,648 A | | 5/1995 | Salkeld et al. | 148/562 |
| 5,753,056 A | * | 5/1998 | Opalka et al. | 148/703 |
| 5,985,059 A | * | 11/1999 | Opalka et al. | 148/703 |

* cited by examiner

*Primary Examiner*—Stephen Kalafut
*Assistant Examiner*—Julian A. Mercado
(74) *Attorney, Agent, or Firm*—Tracey D. Beiriger

(57) ABSTRACT

A method of controlling bulk absorption of atomic hydrogen and facilitating degassing of hydrogen from aluminum alloy workpieces during heat treatments in furnaces with ambient and/or moisture-laden atmospheres to prepare for fabrication in sequential working stages, the method includes exposing the surface of the workpieces to an etching process after each or any of the sequential working stages, and subjecting the workpieces to a final etch treatment using an inorganic alkaline or acidic etch solution modified by an addition of five to twenty-five weight percent transition metal chloride salt before being subjected to said heat treatment. The workpieces exposed to the transition metal chloride salt modified etch solution are subjected to the heat treatment. The etch solution is used to substantially decrease the amount of atomic hydrogen entering the bulk of the workpieces and to facilitate removal of atomic and molecular hydrogen from the bulk of the workpieces during the heat treatment.

6 Claims, 1 Drawing Sheet

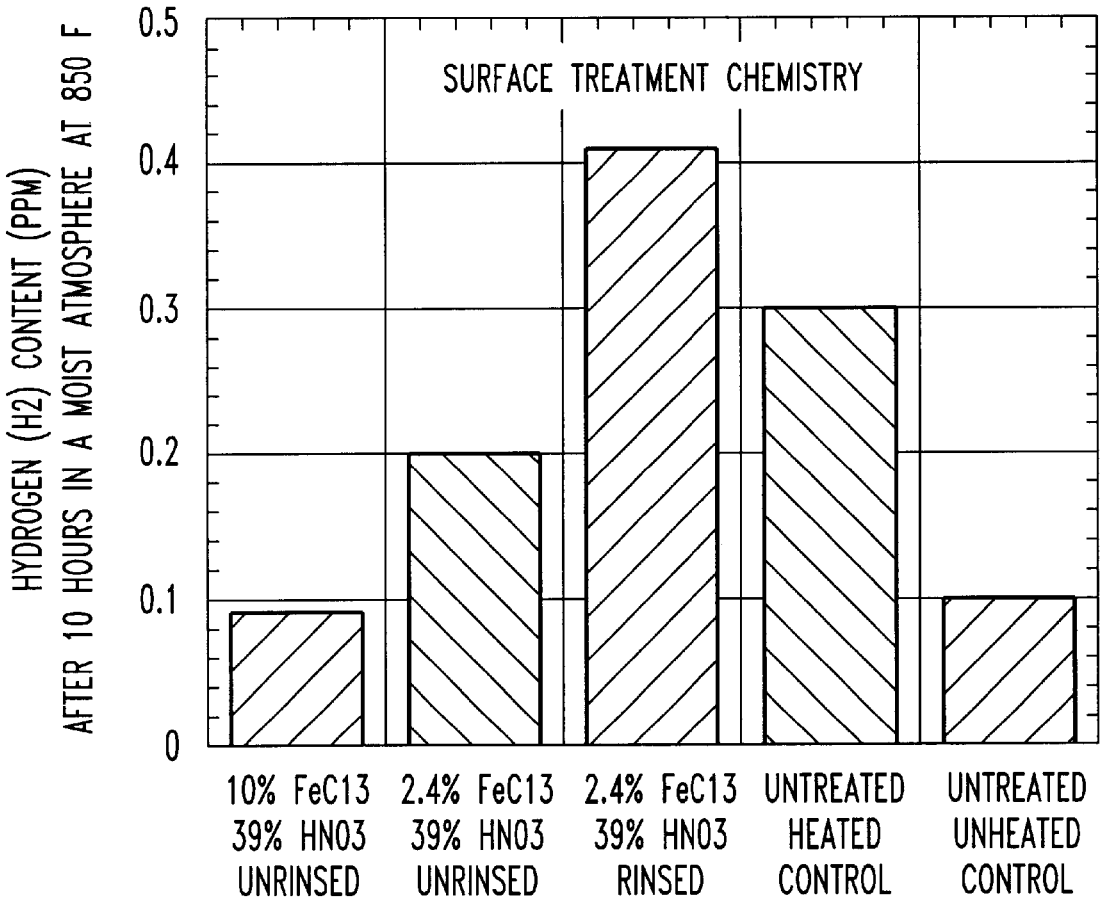
HYDROGEN (H2) CONTENT (PPM)
AFTER 10 HOURS IN A MOIST ATMOSPHERE AT 850 F
0.5
0.4
0.3
0.2
0.1
0
SURFACE TREATMENT CHEMISTRY
10% FeC13 39% HN03 UNRINSED
2.4% FeC13 39% HN03 UNRINSED
2.4% FeC13 39% HN03 RINSED
UNTREATED HEATED CONTROL
UNTREATED UNHEATED CONTROL

MODIFIED ETCHING BATH FOR THE DEPOSITION OF A PROTECTIVE SURFACE CHEMISTRY THAT ELIMINATES HYDROGEN ABSORPTION AT ELEVATED TEMPERATURES

This application is a continuation-in-part of application Ser. No. 08/756,289, filed on Nov. 25, 1996, now U.S. Pat. No. 5,753,056, the disclosure of which is fully incorporated by reference herein.

BACKGROUND OF THE INVENTION

The present invention relates generally to the problem of aluminum alloy workpieces absorbing hydrogen when undergoing heat treatment in furnaces containing ambient moisture-laden atmospheres, and particularly to an etch cycle in making aluminum components using a transition metal chloride salt in the final step of the etch cycle, the salt being added to either an alkaline or acidic etch bath.

When an aluminum alloy object is heated in the presence of moist air, a protective oxide layer on the aluminum object is invariably disrupted to expose nascent aluminum. Aluminum oxidation in the presence of water, while in a heated furnace, generates atomic hydrogen, which readily diffuses into the aluminum object, and is the only gas that has appreciable solubility in aluminum. Still, atomic hydrogen has limited solubility in metal and has the propensity to precipitate in the metal as insoluble molecular hydrogen ($H_2$) at heterogeneities or defects, especially in highly worked regions within the metal object. As increasing hydrogen is precipitated within pores in the metal, additional hydrogen can be absorbed and accommodated within the metal matrix. Bulk porosity in an aluminum workpiece can compromise structural integrity and the mechanical performance of the final aluminum part.

For several decades, ammonium fluoborate ($NH_4BF_4$) protective atmospheres have been used in the industry to prevent substantial absorption of hydrogen by aluminum alloy workpieces during high temperature furnace treatments. Ammonium fluoborate decomposes during such treatments at temperatures above 482° F. to form a blanket atmosphere that fills the entire internal volume of a furnace. Ammonium fluoborate also produces an array of compounds in the furnace which can eliminate high temperature oxidation reactions by either reacting with ambient water or by forming a protective fluorinated layer on the aluminum alloy workpiece.

There are drawbacks to the use of ammonium fluoborate atmospheres, however. Ammonium fluoborate species can stain and pit surfaces of some aluminum alloys. The ammonium fluoborate decomposition products contain toxic, corrosive and particulate species. The ammonium fluoborate emissions corrode furnace structures and baghouses for filtering particulate emissions. Disposal of the collected particulates is costly. Concerns relating to the emissions have prompted research to identify alternative chemistries that are more environmentally friendly and safer for in-plant use.

During certain typical processing sequences in forging aluminum components, the surfaces of the components are frequently subjected to an etch cycle between fabrication stages to enable better surface inspection and possible hand repair of surface defects. Such etch cycles can consist of a caustic etch and a nitric acid desmut, each followed by one or more water rinses. The caustic etch removes lubricant and excess oxide that accumulates during the forging processes.

The nitric acid desmut removes smut, a dark residual film of alloying constituents that have low solubility in a caustic bath, especially copper, magnesium and silicon containing phases. Often, the caustic etch is preceded by a nitric etch, which is believed to weaken bonding of residual lubricant on the component surfaces.

BRIEF SUMMARY OF THE INVENTION

The present invention involves a simple modification of an existing etching operation to provide a protective chemistry on aluminum workpieces prior to being heated in moisture-laden atmospheres and worked at high temperatures. The protective chemistry of the invention can be applied during a final nitric acid desmut step, in which case the composition of the nitric acid solution is modified by addition of 5 to 25 wt. % transition metal chloride salt and elimination of the final rinse. During subsequent heat treatments, the deposited chemistry on the etched aluminum surface consumes any atomic hydrogen generated by high temperature surface oxidation reactions or outgassed from the aluminum bulk. Experimentation has shown the efficacy of adding 10 parts ferric chloride to 90 parts of a 39 wt. % nitric acid solution, the latter being a typical desmutting composition. As explained in detail below, the hydrogen contents of aluminum samples treated with such a composition remained low during a subsequent heat treatment in a moisture-laden atmosphere.

THE DRAWING

The advantages and objectives of the present invention will be better understood from consideration of the following detailed description and the accompanying drawing, the sole FIGURE of which is a bar plot showing molecular hydrogen content in parts per million (ppm) in aluminum components heated at 850° F. for 10 hours in a moisture-laden atmosphere. The components had treated and untreated surfaces including the chemical etch treated surface of the subject invention.

PREFERRED EMBODIMENTS

Aluminum alloy workpiece etch practices, conducted prior to high temperature fabrication, are modified by the addition of 5 to 25 wt. % transition metal chloride salt to the last etch bath and by eliminating final rinses to ensure retention of protection chemistries on the aluminum part. The salt can be added to either an aqueous inorganic alkaline etch bath, with a pH greater than 9, or an aqueous inorganic acidic etch bath, with a pH less than 3. Experimentation has shown the efficacy of adding 10 parts ferric chloride to 90 parts of a 39 wt. % nitric acid solution, the latter being a typical desmutting composition. Three samples initially treated with such a composition for sixty seconds had an average hydrogen level of 0.09 ppm following ten hours heat treatment at 850° F. in water-saturated air. When compared to the 0.30±0.02 average hydrogen level of untreated control samples heated under identical conditions, it is apparent that the subject composition effectively minimizes hydrogen levels during heating.

The hydrogen levels of all of the above conditions are illustrated in the bar plot of the drawing figure. Certain conditions are necessary for the subject success of the transition metal. The plot shows that a lesser ferric chloride concentration of 2.4% is only partially effective in eliminating hydrogen absorption compared to the untreated, heated control samples. The need for eliminating final rinses is illustrated by a sample that was rinsed following treatment in the latter composition. The hydrogen level after heating was even higher than the untreated, heated control samples.

The protective chemistry of the invention can be applied to aluminum components to prevent absorption of hydrogen during heating in moist atmospheres. The treatment would supplant the need for ammonium fluoborate protective atmospheres and could be readily integrated into virtually any production regime. The chemistry can be applied by modification of an existing etching process, as explained above, and would not require additional processing equipment or product handling. A modified etch application prior to each heating operation in a process in which aluminum components are worked would maintain low bulk hydrogen levels in the aluminum products.

The invention has the further advantage of substantially reducing particulate emissions, compared to the fluoboride and particulate emissions from furnace practices involving ammonium fluoborate atmospheres. The elimination of particulates, of course, eliminates the need and cost of baghouses and landfill sites for particulates, while application of surface treatment directly to aluminum components has the potential for dramatically reduced emissions compared to the blanket protective atmosphere produced by bulk ammonium fluoborate decomposition.

Surface segregation of alloying elements, such as copper and magnesium, offer a mechanism of reducing possible chloride emissions during heat treatment of transition metal chloride salt modified-etch treated aluminum alloy workpieces. During heating, the oxides and hydroxides of these elements can react with atomic hydrogen and ferric chloride. In the process, more thermally stable magnesium and copper chlorides may be formed instead of volatilized aluminum chloride or hydrochloric acid. Such reactions can be enhanced by taking the selective solubility of the alloying elements into account. Etching compositions that leave a residue or smut of insoluble alloying elements on the surface of components at the end of a heat treating stage ensure that these species can be present for reactions at the onset of the next following heat treating stage.

In using the invention, surfaces of a workpiece can be dipped, coated or sprayed with the composition of the invention employing a minimum exposure time of about 5 seconds, and then heated in a furnace with an ambient moist atmosphere, without wiping or rinsing of the surfaces of the workpiece before placement in the furnace. If the surface of an aluminum alloy workpiece is particularly dirty or oily, the surface can be prepared before dipping by cleaning with a solvent or degreasing agent.

In addition to the compositions of the above solutions, certain additional agents can be incorporated in the compositions. Surfactant species may be incorporated to improve the formulation wetting on aluminum alloy workpiece surfaces and to ensure al more uniform surface reaction.

What is claimed is:

1. A method of controlling bulk absorption of atomic hydrogen and facilitating degassing of hydrogen from aluminum alloy workpieces during heat treatments in furnaces with ambient and/or moisture-laden atmospheres, the method comprising:

treating a workpiece, said treating comprising applying a nitric acidic etch solution, modified by an addition of five to twenty-five weight percent transition metal chloride salt to said workpiece, such that said etch solution etches said workpiece and said transition metal chloride salt is deposited on said workpiece; and subjecting said workpiece to a heat treatment wherein said treating substantially decreases the amount of atomic hydrogen entering the bulk of the workpiece and facilitates removal of atomic and molecular hydrogen from the bulk of the workpiece during the heat treatment.

2. The method of claim 1 wherein the pH of the aqueous inorganic acidic etch bath is less than 3.

3. The method of claim 1 wherein the aluminum alloy workpieces are exposed to the etch solution for a minimum exposure time of about five seconds.

4. The method of claim 1 wherein the aluminum alloy workpieces exposed to the etch solution are subjected to the heat treatment without wiping or rinsing the workpieces prior to such heat treatment.

5. The method of claim 1 wherein the aluminum alloy workpieces are subjected to degreasing and/or cleaning with a solvent and/or alkaline etch followed by a water rinse and a transition metal chloride salt modified acidic etch, without rinsing in water, before being subjected to said heat treatment.

6. The method of claim 1 wherein a wetting agent or dispersant is incorporated into the transition metal chloride salt modified etch solution to facilitate uniform treatment of the aluminum alloy workpieces.

* * * * *